US008439125B2

(12) United States Patent
Teebken

(10) Patent No.: US 8,439,125 B2
(45) Date of Patent: May 14, 2013

(54) APPARATUS, METHOD AND SYSTEM FOR DEEP EARTH GROUNDING

(75) Inventor: Richard L. Teebken, Fremont, NE (US)

(73) Assignee: Grounding Perfection, Inc., Fremont, NE (US)

( * ) Notice: Subject to any disclaimer, the term of this patent is extended or adjusted under 35 U.S.C. 154(b) by 615 days.

(21) Appl. No.: 12/357,055

(22) Filed: Jan. 21, 2009

(65) Prior Publication Data

US 2009/0183890 A1 Jul. 23, 2009

Related U.S. Application Data

(60) Provisional application No. 61/022,711, filed on Jan. 22, 2008.

(51) Int. Cl.
*E21B 7/04* (2006.01)

(52) U.S. Cl.
USPC ..... 173/1; 173/184

(58) Field of Classification Search ..... 173/25, 173/86, 187, 1, 35, 184
See application file for complete search history.

(56) References Cited

U.S. PATENT DOCUMENTS

| | | | | | |
|---|---|---|---|---|---|
| 510,198 | A * | 12/1893 | Shaw | ..... | 173/184 |
| 918,944 | A * | 4/1909 | Aunes | ..... | 173/124 |
| 2,165,853 | A * | 7/1939 | Hart | ..... | 173/147 |
| 2,450,278 | A * | 9/1948 | Fuehrer | ..... | 280/43.1 |
| 5,117,920 | A * | 6/1992 | Soble | ..... | 173/28 |
| 7,121,357 | B1 | 10/2006 | Raimondi | | |

FOREIGN PATENT DOCUMENTS

| | | | |
|---|---|---|---|
| EP | 0616081 | B1 | 1/1997 |
| JP | 2000-164312 | A | 6/2000 |
| KR | 10-2005-0048407 | A | 5/2005 |

OTHER PUBLICATIONS

International Search Report, Grounding Perfection, Inc. et al., PCT/US2009/031559, Dated Aug. 31, 2009, 4 Pages.
"INFRASPEC Low-Resistance Deep Earth Grounding" The future in technology is low-resistance grounding . . . brochure, Dated prior to Jan. 22, 2007, 2 pages.

* cited by examiner

*Primary Examiner* — M. Alexandra Elve
*Assistant Examiner* — Nathaniel Chukwurah
(74) *Attorney, Agent, or Firm* — McKee, Voorhees & Sease, P.L.C.

(57) ABSTRACT

An apparatus and method for deep earth grounding includes positioning a power driver at a site, the power driver comprising a frame and an impact hammer operatively connected to the frame, adjusting placement of the impact hammer, raising the impact hammer, driving 10 foot sectioned grounding rods down into the ground at the site using the hammer, testing resistance, and determining if more additional grounding rods are necessary based on the resistance. A power driver device includes an open frame, guide rails operatively connected to the frame, an impact hammer operatively connected to the guide rails and moveable along the guide rails, and a hand crank assembly operatively connected to the frame and configured for raising the guide rails and the impact hammer up and down along the frame.

12 Claims, 11 Drawing Sheets

APPARATUS, METHOD AND SYSTEM FOR DEEP EARTH GROUNDING

CROSS-REFERENCE TO RELATED APPLICATIONS

This application claims priority under 35 U.S.C. §119 of a provisional application Ser. No. 61/022,711 filed Jan. 22, 2008, which application is hereby incorporated by reference in its entirety.

FIELD OF THE INVENTION

The present invention relates to grounding. More particularly, the present invention relates to deep earth grounding.

BACKGROUND OF THE INVENTION

Proper earth grounding has become increasingly important with increased use of electronic equipment in residences and businesses. Electronic and computer equipment are continuously upgraded and require better grounding to eliminate production problems. In fact, proper earth grounding is needed to reduce or eliminate static charge build-up and power surges, including those from lightning, which can cause power failures, damage electronic equipment, or otherwise creates costly and inconvenient problems.

Although it is generally recognized that grounding rods are preferable to methods such as using the water supply line, there is often little understanding regarding how deep grounding rods must be for a particular location. This can result in installing grounding rods at insufficient depths which fail to adequately reduce or eliminate static charge build-up and power surges, and further provide adequate grounding. In addition, due to a lack of understanding regarding how deep grounding rods must be for a particular location, especially considering the all the different types of sub-terrain materials resulting in different electrically conductivity, often times engineers and electricians fail to properly diagnose insufficient grounding as the problem.

Where grounding rods are installed, grounding rods are generally installed by one of four methods, with all of these methods operator personal safety is a prevailing concern.

According to a first method, a truck mounted power driver may be used. There are several problems with such a method. First, there needs be proper accessibility at the site for this type of large equipment. In addition, there may be availability issues for such equipment and the use of such equipment is often costly.

According to a second method, a commercial driver may be used which is generally a variation of the post driver. A third method is to construct tools that resemble fence post drivers or shortened sledge hammers. A fourth method is to use sledge hammers. These methods are not easy to use, labor intensive, and time consuming. Furthermore, these methods entail exposing the operator to varying degrees of danger. For example, with the third and fourth methods, the operator must position him/herself above the ground at the height of the rod. If a 10 foot rod is being driven into the ground, the operator must be able to access the top of the rod. This typically is done using a ladder and can be very dangerous as the operator is on a ladder trying to drive the rod into the earth. The installation process can be even more dangerous where a single operator without assistance of another is practicing these methods, which is typically is the case in the field as companies try to conserve resources, time, money and manpower. Needless to say, significant injury and even death has occurred on occasion where the operator has lost his/her balance and fallen upon the rod or been struck by the tool used to impact and drive the rod into the earth.

The combination of not understanding the proper depth for grounding rods in addition to the labor intensiveness of installing grounding rods tends to compound the problem of not providing sufficient deep earth grounding.

What is needed is an efficient and effective method, system and apparatus for deep earth grounding.

Therefore, it is a primary object, feature, or advantage of the present invention to improve over the state of the art.

It is a further object, feature, or advantage of the present invention to provide state of the art methods, systems and apparatuses for deep earth grounding.

Another object, feature, or advantage of the present invention is to provide for effective deep earth grounding.

A still further object, feature, or advantage of the present invention is to provide an easy and safe method for driving deep grounding rods.

Yet another object, feature, or advantage of the present invention is to provide a driver for grounding rods which allows for safe and rapid installation.

A still further object, feature, or advantage of the present invention is to provide a method, system and equipment for deep earth grounding which allows for installing ground rods to a sufficient depth to assist in preventing grounding problems.

Yet another object, feature, or advantage of the present invention is to provide equipment to assist in deep earth grounding which is easy to maneuver, user friendly, and safe to operate and install ground rod.

A still further object, feature, or advantage of the present invention is to provide equipment which allows deep earth grounding to be performed by a single individual.

Another object, feature, or advantage of the present invention is to provide a method, system and equipment for deep earth grounding that accounts for the various types of earth in which the ground rod is installed.

These and/or other objects, features, or advantages of the present invention will become apparent. No single embodiment of the present invention need achieve all or any particular number of the foregoing objects, features, or advantages.

SUMMARY OF THE INVENTION

According to one aspect of the present invention a method of deep earth grounding is provided. The method includes positioning a power driver at a site, the power driver comprising a frame and an impact hammer operatively connected to the frame, adjusting placement of the impact hammer, raising the impact hammer, driving at least one or more grounding rods down into the ground at the site using the hammer, testing resistance, and determining if at least one or more additional grounding rods are necessary based on the resistance.

According to another aspect of the present invention, a power driver device is provided. The power driver device may include a frame having vertical members extending from top to bottom and horizontal members, the horizontal members extending away from the vertical members at the bottom such that the frame is an open frame; guide rails operative connected to the frame. The device may also include an impact hammer operatively connected to the guide rails and moveable along the guide rails, and a hand crank assembly operatively connected to the frame and configured for raising the guide rails and the impact hammer up and down along the frame.

DETAILED DESCRIPTION

The present invention is directed towards a device and related methods for deep earth grounding.

Figure 1:
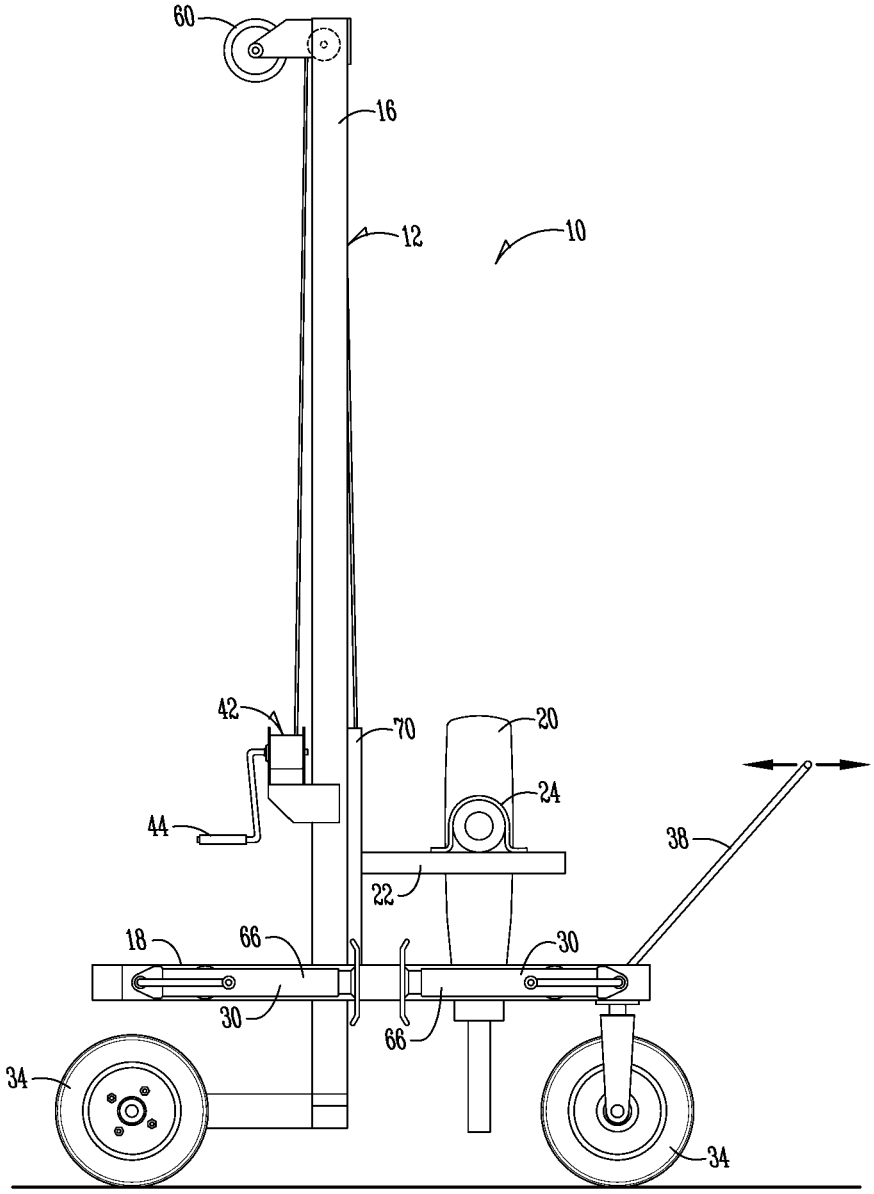
FIG. 1 is a side view of one embodiment of a driver device.

FIG. 1 illustrates one embodiment of a device 10. The device 10 has a frame 12 which includes upright or vertical members 16 operatively connected to horizontal members 18. In operation, an impact hammer assembly 19 is raised or lowered.

Figure 4:
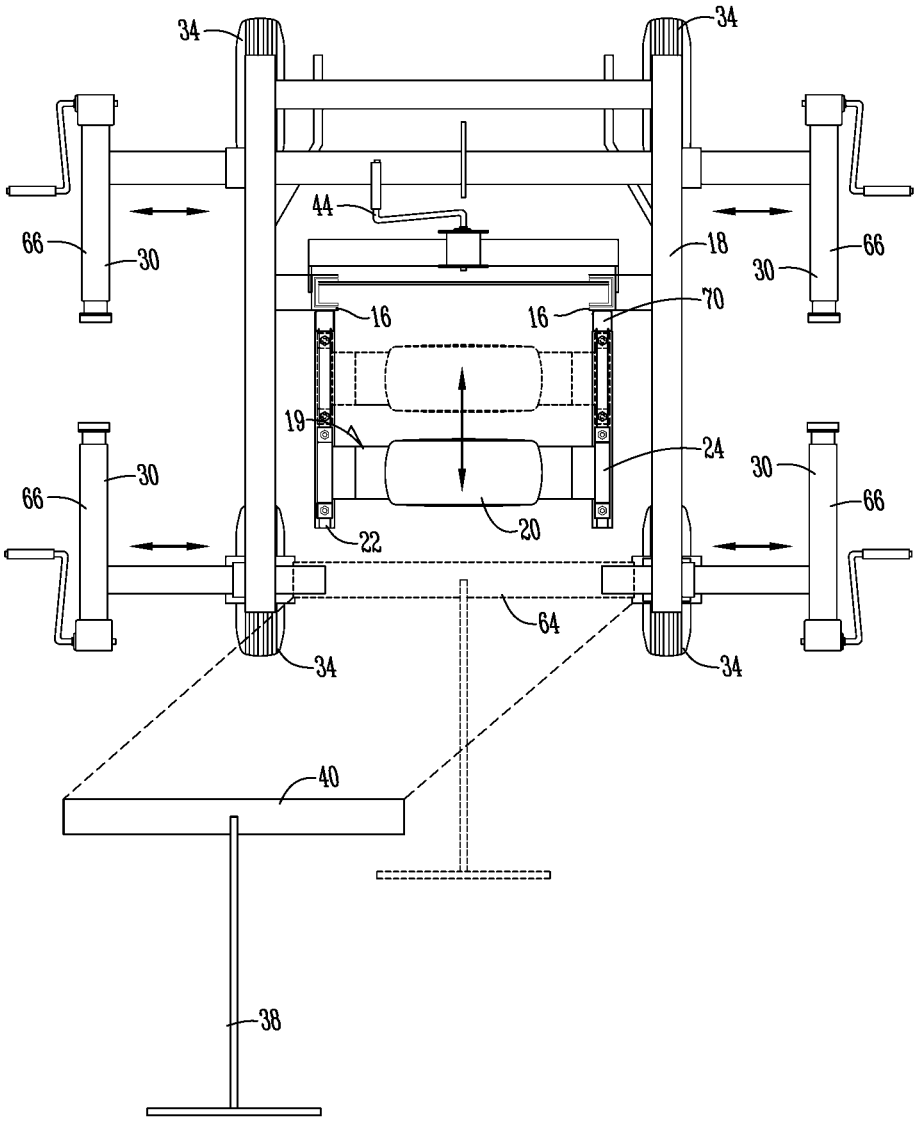
FIG. 4 is a plan view of the driver device according to an exemplary embodiment of the present invention.

An impact hammer 20 (or impact driver) is supported on rails 22. The impact hammer 20 is preferably electric, but could be pneumatically, hydraulically or gas driven. Straps 24 allow for the impact hammer 20 to be moveably positioned along the rails 22 and secured in place as best illustrated in FIG. 4. The ability of the impact hammer 20 to be positioned horizontally along the rails 22 is advantageous as it enhances accessibility to different site locations that may not be otherwise reached. For example, the impact hammer 20 may be positioned right up against or along side a vertical wall or in other locations which would otherwise be inaccessible using other methods. Straps 24 are shown for moving the impact hammer 20 horizontally along the rails 22.

Figure 5A:
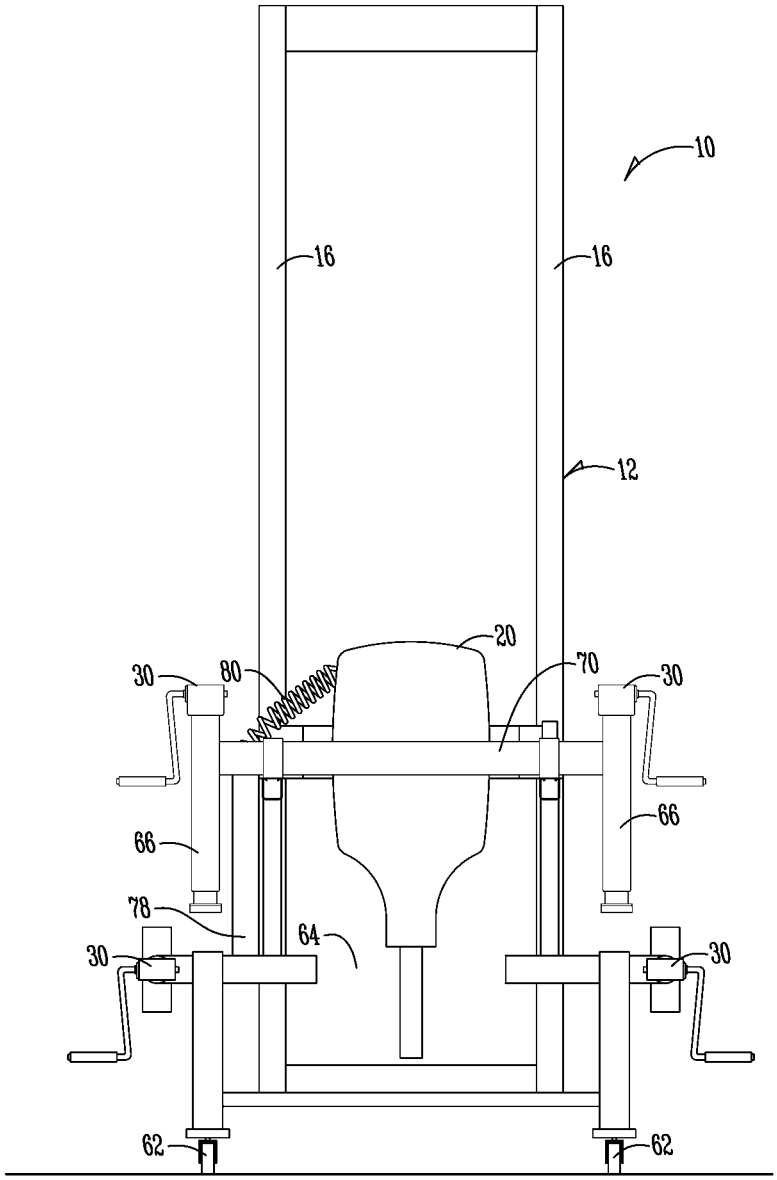
FIG. 5A is a front view of another driver device according to an exemplary embodiment of the present invention.
Figure 5B:
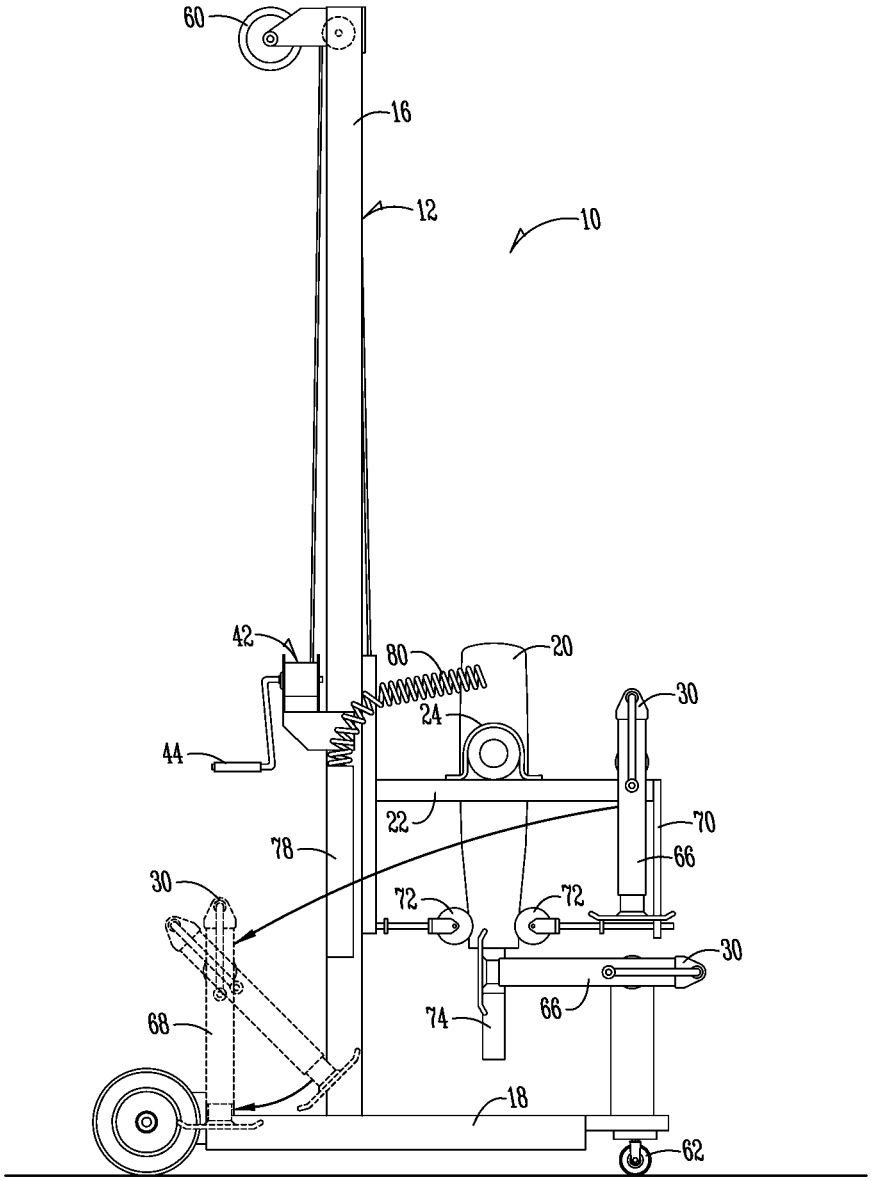
FIG. 5B is a side view of another driver device according to an exemplary embodiment of the present invention.

The frame 12 allows for open front access which assists in maneuverability of the device 10 as shown in FIGS. 4 & 5A-B. The open front access can be highly advantageous. The impact hammer 20 may be lifted up, and jacks 30 may be raised and the power driver 10 may then be backed away from a rod 46 extending from the ground. Thus, for example if a rod 46 cannot be driven into the earth all the way because of some underground obstruction, the rod 46 does not need to be removed before the device 10 can be moved. This allows the operator to access the point where the rod 46 and earth junction without having the device 10 hanging overhead to prevent possible injury or harm to the operator if an accident were to occur.

In the case of device 10 shown in FIG. 4, the handle 38 attached to tug bar 40 detaches from the front of the device 10 to open the front of the device 10. When not in the open face configuration shown in FIG. 4, the handle 38 attached to tug bar 40 may be used to assist in moving the device 10 as shown in FIG. 1. Because there is no axle extending between and connecting the front wheels 34, removal of tug bar 40 provides an open front 64 of device 10, allowing for open front access. Such open front access can be particularly useful for moving the device 10 away from a rod 46 protruding from the ground (as best illustrated in FIG. 6).

FIG. 5A-B show another embodiment of device 10 having a continuously open front 64. In FIG. 5A-B, horizontal members 18 extend forward from vertical members 16 of device 10 and are supported by casters 62 at the open front 64. The open front 64 of device 10 shown in FIG. 5A-B allows device 10 to be moved into position and away from and overtop the work area even when an obstruction, such as rod 46 is protruding from the ground without having to alter the configuration of device 10. The open front 64 of device 10 also provides for better maneuverability in tight areas, such as for example where device 10 is maneuvered around comers, through hallways and doors to access or be correctly positioned at the worksite. Device 10 may configured to have a narrower stance (shorter distance between horizontal members 18) and wheelbase, and vertical members 16 may be reduced in height so that device 10 can be maneuvered and operated easier in tight or restrictive quarters.

There is a wheel 34 at one end of each horizontal member 18 and another wheel 34 at the opposite end of each horizontal member 18, which could be attached to either the horizontal member 18 or vertical member 16 of frame 12. Each wheel 34 allows for swivel movement over a full 360 degree range. In the case of device 10 shown in FIG. 5A-B, front wheels (casters 62) and rear wheels 34 are substantially in plane with horizontal member 18 so that the overall width of device 10 is no wider than needed. This enhances maneuverability of the device 10 and ensures that device 10 can be maneuvered through tight spaces, even a standard size door, to access the installation site 56, such as for example where the installation site 56 is only accessible by passing through a building or other structure.

Figure 6:
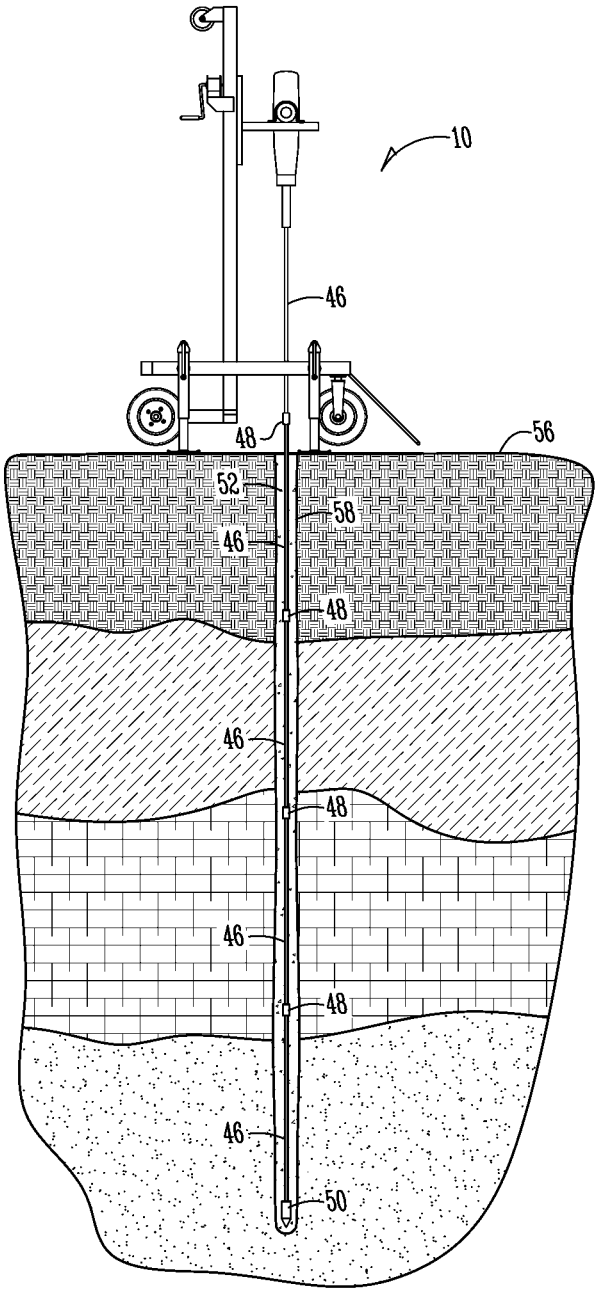
FIG. 6 is a cross sectional view of the earth at an installation site using the driver device to install the grounding rod.

Akin to outriggers, jacks 30 may be extended and used to elevate the device 10 off of the wheels and provide stabilizing support 34 during the driving process as shown in FIG. 6. Jacks 30 are preferably removably and rotatably attached to horizontal members 18. For example, jacks 30 may be rotated between transport 66 and working positions 68 as shown in FIGS. 3, 4, and 5A-B. In working position 68, jacks 30 may also be extended outward away from horizontal members 18 or frame 12 to provide a larger support, base or footing for supporting operation of and leveling for device 10. In the transport position 66, jacks 30 may be rotated and pinned in position, such as for example as shown in FIG. 1. Jacks 30 may also be unpinned from frame 12 or horizontal members 18, removed and set aside or temporarily hinged or pinned out of the way and/or to frame 12, such as shown in FIG. 5A-B. Removal of jacks 30 from horizontal members 18 or frame 12 allows the overall width of device 10 to be no wider than needed. This allows device 10 to be maneuvered through and operated in tight or confined areas. The present invention further contemplates that horizontal members 18 may be removably mounted to frame 12 for storage and/or transport of device 10 in the reclined position (shown in FIG. 7). Wheels 34 could also include wheel locks for securing device 10 whether while in operation or in transit between installation sites 56.

A crank assembly 42 with manual hand crank 44 is used to raise and lower the impact hammer on driver 20 up and down vertical members 16. The present invention contemplates that hammer 20 may be electrically, pneumatically or hydraulically raised and lowered about vertical members 16. Ideally, the impacting end of hammer 20 is lowered at a rate during impacting such that a ½ inch to 1 inch gap is continually maintained between the impacting surface of the hammer 20 and the end of rod 46. This is ideal as is maximizes the impacting efficiency of hammer 20 and thereby minimizes the time required to impact the rod 46 into the ground. Device 10 may include one or more leveling indicators to indicate to the operator when device 10 is level relative to the installation site 56.

Device 10 includes a carriage 70 having rails 22 for supporting hammer 20. As previously mentioned, hammer 20 is attached to rails 22 by straps 24. Opposing handles of hammer 20 are inserted into elastomeric bushings, which are secured within straps 24. Elastomeric bushings help cushion operation of and absorb the vibrations from hammer 20. Carriage 70 also includes rollers 72 for rotatably supporting vertical translation of hammer 20 during impacting. Rollers 72 are adjustable along horizontal all thread members, whereby rollers 72 may be adjusted to a position directly adjacent the barrel of hammer 20 for sandwiching hammer 20 between the rollers 72. The present invention also contemplates that hammer 20 may be rotated or inclined within carriage 70 by altering the position of rollers 72 along the horizontal all thread members; however, it is preferable to keep hammer 20 vertical relative to the installation site 56 at all times to maximize the impacting efficiency of the hammer 20 and reduce wear and tear on the hammer 20 and the rod 46 being installed.

Figure 2:
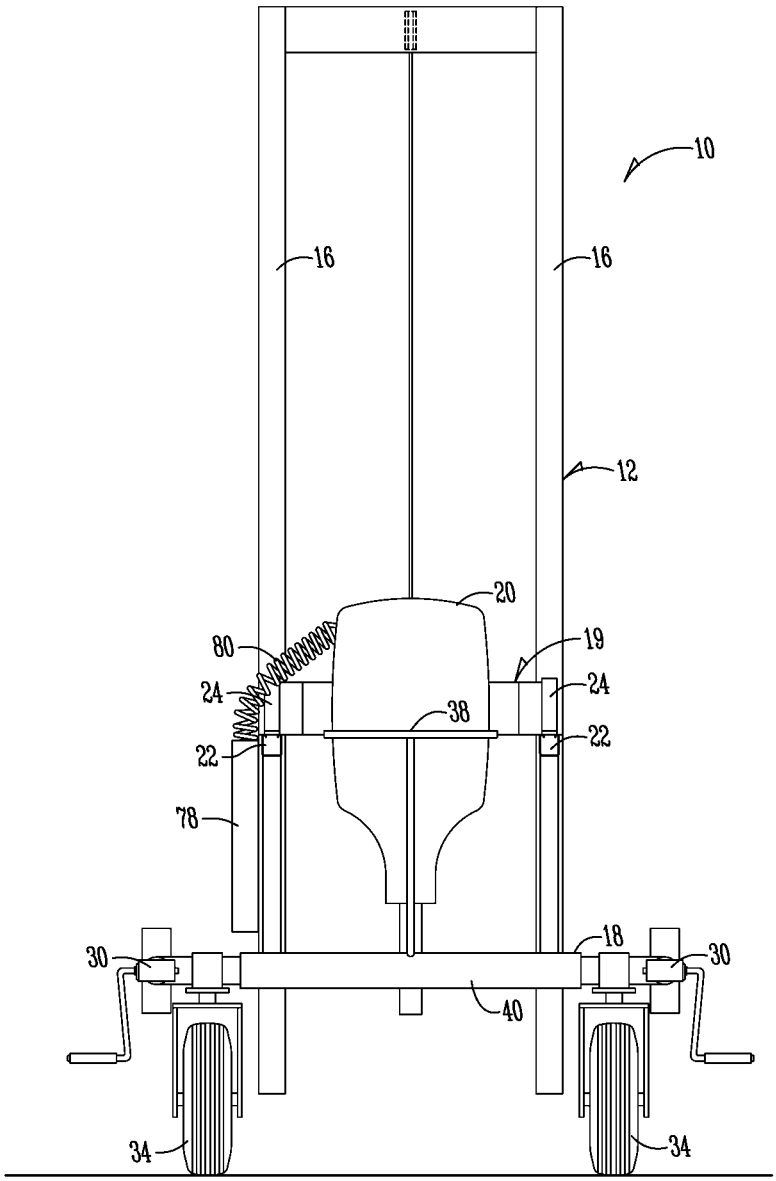
FIG. 2 is a front view of the driver device of FIG. 1.

FIG. 2 provides a front view of the device 10 of FIG. 1. Note that two jacks 30 are present on opposite sides of device 10 for raising and supporting the device once device 10 is in position at the installation site 56. Jacks 30 may be removed thereby narrowing the width of device 10 to increase the maneuverability of device 10 in tight quarters.

As best illustrated in FIG. 6, in operation, the device 10 provides for driving rod 46 to use as a ground electrode. Before using the device 10 to drive rod 46 at a particular site, it is recommended that the site be surveyed and marked for underground utilities and other possible obstructions that will impede or cause danger to the operator and/or electrode installation. Overhead obstructions should also be identified. In one embodiment of the present invention, the device 10 can extend to approximately 15.6 feet and can be used to drive 10 foot sections of rod 46. If overhead obstructions are present which would limit extension of the machine, then shorter sections of rods 46 (and increased number of couplings 48) may be used. If the area where the rod 46 is to be driven is within a confined area, such as a basement utility room, jacks 30 may be removed from device 10, the hammer 20 lowered (and the vertical members 16 potentially collapsed) to permit device 10 to be maneuvered into the work area, even including an elevator providing access to the installation site 56.

Figure 3:
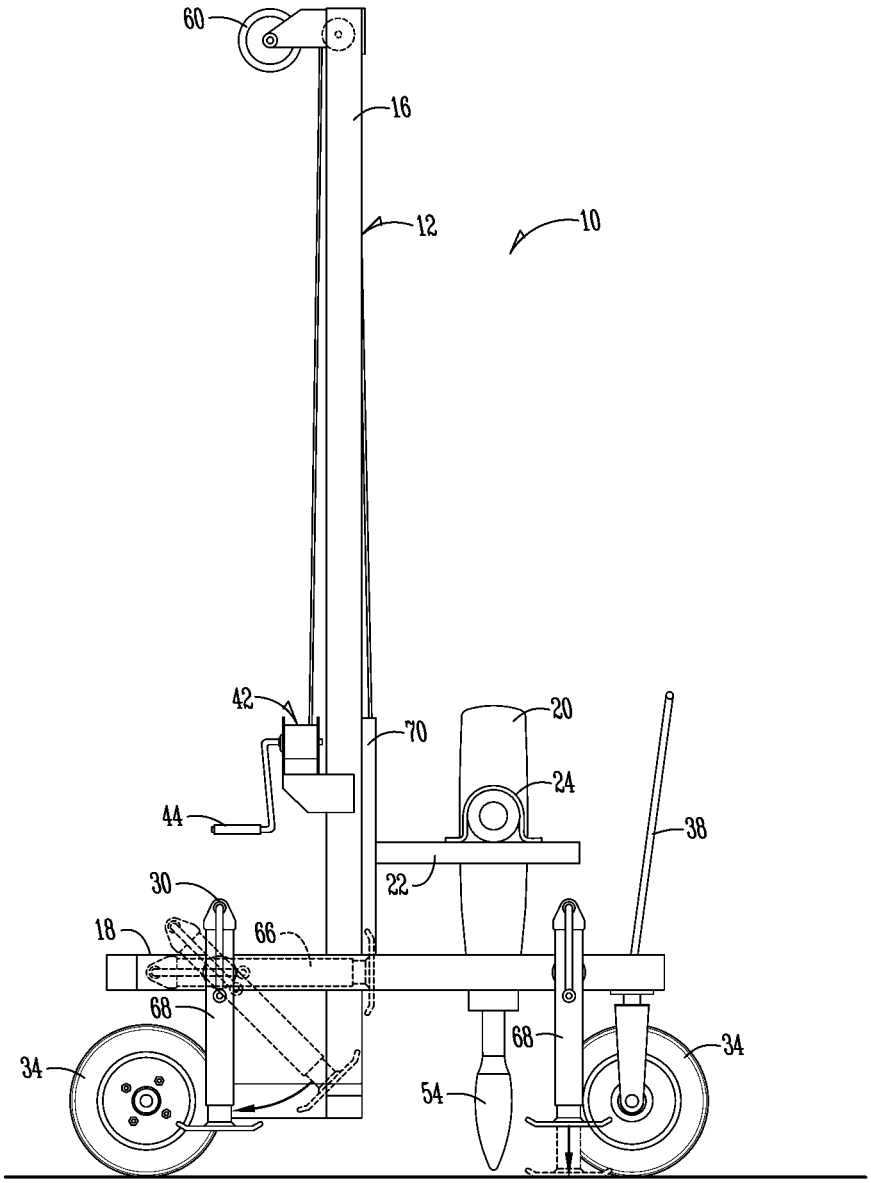
FIG. 3 is another side view of the driver device shown in FIG. 1.

In the case where rod is impacted into the earth as opposed to boring/drilling the hole 58, the impact hammer 20 may be configured with a tapered starter bit 54 (illustrated in FIG. 3). The tapered starter bit 54 is a drive bit which is tapered to prepare a correct sized earth hole (starter hole) for insertion and holding a tapered plastic funnel (not shown) firm for bentonite application while simultaneously impacting rod 46 into the earth. Thus, the first section of rod 46 to be impacted into the earth is inserted through the tapered plastic funnel resting within the starter hole formed by the tapered starter bit 54.

In all cases where the earth at the installation site 56 permits driving rod 46 through it, device 10 may be positioned over the installation site 56 and the jacks 30 extended (like outriggers) in the outmost position and lowered until they make contact with the ground in preparation for using the hole formed by tapered starter bit 54 as a guide. After the jacks 30 are all touching the ground, the leveling of the device 10 begins until all weight is off the wheels 34 and the device 10 is balanced on the jacks 30 as indicated by the leveling device (not shown) located under the lift crank handle 44. The device 10 must be level and seated firmly on the ground as installing rod at any angle impedes performance of the hammer 20, the driving of rod 46 into the earth, and bentonite flow around the rod 46 while being impacted into the earth. In fact, the present device 10 allows for level installation of rod 46 and a firm platform from which to drive rod 46 into the earth.

An electrical cord is extended from the device 10 to a supply. For example, a generator is started and the electrical cord 80 is plugged into the appropriate outlet. Electrical cord surplus on the device 10 may be corralled within a housing 78 such that the cord 80 collects within the housing 78 as the hammer 20 is lowered and drawn from the housing 78 as the hammer 20 is raised. The collection and dispersal of electrical cord 80 from the housing 78 protects the cord from accidentally being damaged or causing shock to the operator.

The impact hammer 20 is then turned on and the starter bit 54 is driven into the ground by turning the lift handle 44 counterclockwise. The starter bit 54 should be driven into the ground until the bit retaining collar is even with grade level. After the starter hole is complete, the impact hammer 20 may be raised by turning the lift handle 44 clockwise and so that the starter bit 54 may be removed. The ground electrode/rod drive bit 74 and close bit retaining collar are then installed in place of the starter bit 54. A case hardened drive tip 50 may then be installed to the end of a stainless steel ground rod 46. The end of the rod 46 with drive tip 50 may then be positioned in the starter hole 58 and the impact hammer 20 is raised high enough to clear the end of the rod 46. Then the impact hammer 20 may be lowered down onto the rod 46. The funnel is then filled with dry processed bentonite until just the neck of the funnel is filled. The hammer 20 is turned on and a first section of stainless steel electrode or rod 46 is driven into the earth by lowering the weight of hammer 20 onto the rod 46. As the drive process continues the bentonite level in the funnel may be monitored and more added as needed. The impact hammer 20 should be turned on and a first section of stainless steel electrode or rod 46 driven into the earth by lowering the weight of the impact hammer 20 onto the rod 46. As rod 46 is driven into the earth, the bentonite in the funnel travels downward into the hole 58 with the rod 46. Because the drive tip 50 has a greater diameter than rod 46, there is a gap that exists between the hole 58 created in the earth by the drive tip 50 and the outer circumference of rod 46. This gap is filled by the bentonite as the rod 46 is driven into the earth. The bentonite surrounding the rod 46 is hydrated by water existing naturally within the surrounding earth. The bentonite acts as "earth glue" and provides an adhesive effect to adhere ground rod 46 to the surrounding earth of hole 58.

After the first section of rod 46 is installed, resistance of the installed rod 46 may be tested, such as according to National Electric Code (NEC) and Institute of Electrical and Electronics Engineers (IEEE) recommendations. Test probes may also be installed between 250 and 500 feet in total distance from the installation site 56 in accordance with NEC and IEEE testing recommendations.

As each section of ground rod 46 is impacted, a tapered coupling 48 may be added in preparation for the next section of ground rod 46. The tapered coupling 48 is designed such that as the connection between the adjoining rods 46 (coupled by the tapered coupling 48) become more secure and bound together with each impact by hammer 20. For example, the inner walls of the hole passing through the tapered coupling 48 may have a taper of 1.5% from each end to the middle of the coupler 48. The coupling 48 is designed so that adjoining ends of rods 46 attached by the coupling 48 are separated by a gap, such as for example a ⅝ inch gap that is reduced to ~⅜ inch after impacting. During impacting, coupling 48 expands to receive adjoining rods 46 and preserve the integrity of coupling 48. Consecutive rods 46 are installed using coupling 48 until a depth is reached providing the desired minimum resistance reading. It may take up to 100 feet deep or more to reach the minimum resistance required, such as a resistance better than ~3 ohms. Resistance at the start of installation can be as high as 150 to 200 ohms.

Figure 9:
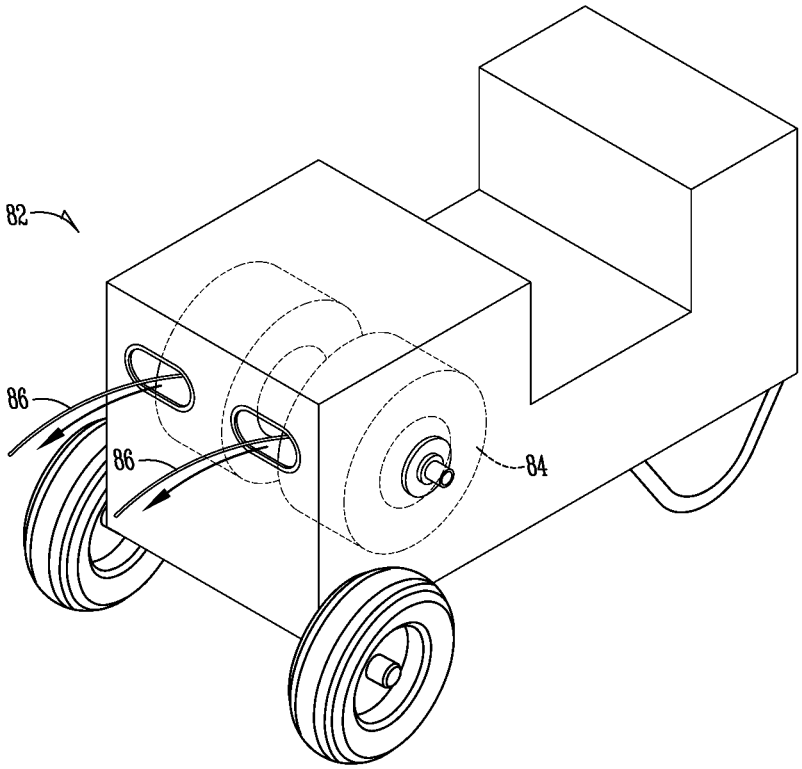
FIG. 9 is a perspective view of a test cart device according to an exemplary embodiment of the present invention.

Preferably, after each 10 foot section of rod 46 is installed, resistance tests should be conducted with an earth megger to indicate resistance readings to the earth. Ideally, resistance continues to drop as the rods 46 are installed deeper into the earth. Resistance also drops as the bentonite in the hole 58 hydrates, expands filling the gap between hole 58 and rod 46, and adheres the rod 46 to the surrounding earth. A typical desired resistance is 3 ohms or less for computer equipment and lightning protection. The tests for resistance may be performed by using a three point fall-of-potential test or two-point testing depending on the site and availability of open ground to perform the tests. The tests may be performed according to National Electrical Codes and IEEE Standards and facilitated using a test cart, such as test cart 82 shown in FIG. 9. The test cart 82 includes two 1,200 foot reels 84 of test cable 86. The test cable 86 is pulled outward from where the rod 46 is installed to a distance beyond the sphere of influence of the newly installed rod to accurately assess the resistance and perform other tests according to NEC and IEEE standards.

Figure 8A:
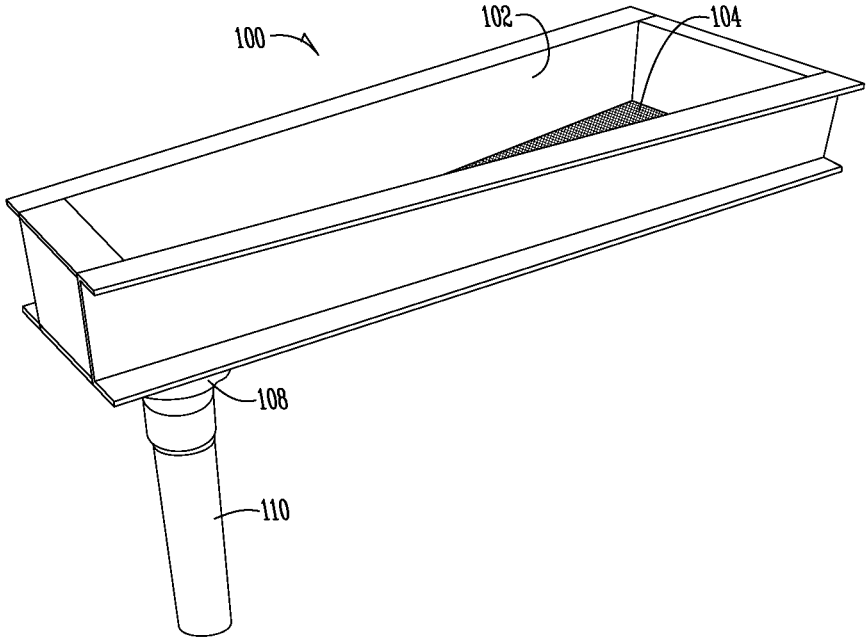
FIG. 8A is a perspective view of a funneling device according to an exemplary embodiment of the present invention.
Figure 8B:
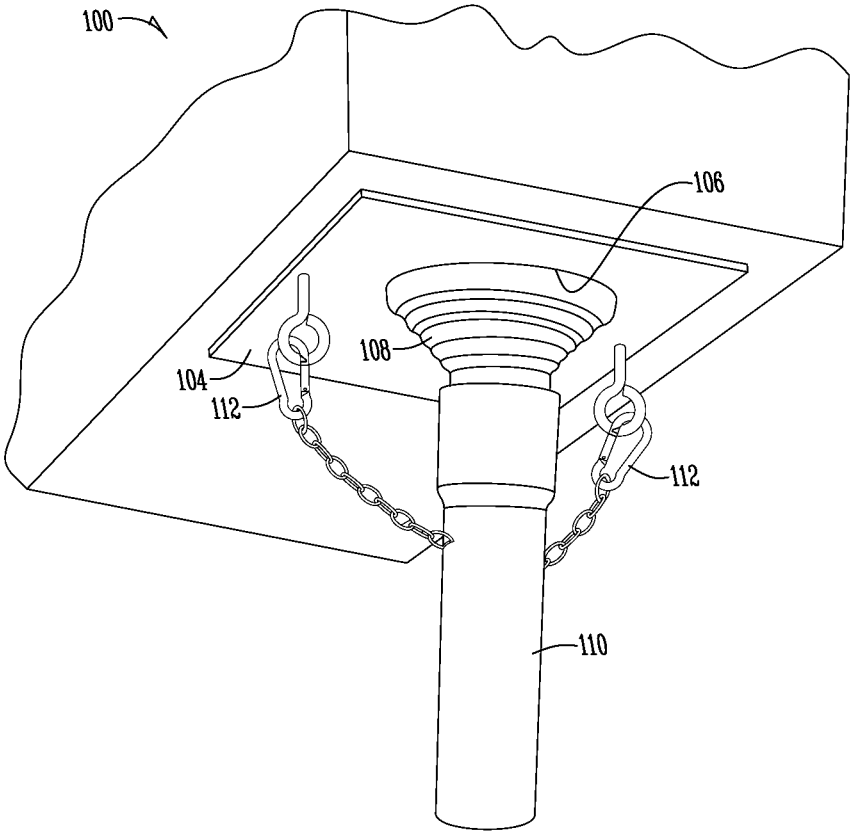
FIG. 8B is an underside view of the funneling device shown in FIG. 8A.

Depending on the hardness of the earth at the installation site 56, in some instances a hole 58 must be drilled or bored into the earth as an alternative method to impacting for installing ground rod 46. Currently, many commercial units exist and businesses provide services for drilling or boring a hole 58 into the earth using commercially available devices, such as a drilling rig. During drilling or boring of the hole 58, an earth megger can be hooked up to the drill stem to indicate resistance to earth at varying depths of the drill bit to determine the proper depth of hole 58. The hole 58 drilled/bored in the earth is typically ~6 inches in diameter. The larger diameter of the hole 58 simplifies the bentonite application process. After hole 58 has been formed, the water level in the hole 58 can be checked with a tape to ensure that enough water exists in the hole 58 to begin the bentonite application process. If the water level in hole 58 is insufficient, the operator may manually add water to hole 58. Using device 100 shown in FIGS. 8A-B bentonite may be carefully poured into the bore hole 58. Device 100 consists of a holding basin 102 for containing the bentonite to be poured into hole 58. The floor 104 of device 100 is preferably a screen for filtering the bentonite (separating the chips/fines from bentonite dust) before moving the chips and fines portion of bentonite leftover in the device 100 into hole 58. An aperture 106 in floor 104 is positioned at one end of device 100. The floor 104 of device 100 may be inclined or angled toward the aperture 106 to encourage movement of bentonite chips and fines toward aperture 106. Attached to the aperture 106 is funnel 108 with ribbed sidewalls. A dispensing tube 110 is removably attached to device 100 so that funnel 108 is received in the mouth of the dispensing tube 110. Dispensing tube 110 is removably attached to device 100 by clips 112. Clips 112 allow dispensing tube 110 to be partially removed from device 100 whereby access is gained to hole 58 through dispensing tube 110 for troubleshooting purposes. Clips 112 also keep dispensing tube 110 from separating from device 100 and falling down into bore hole 58. The funnel 108 is designed having ribbed sidewalls to assist in metering specific amounts of bentonite into hole 58 to prevent the hole from becoming occluded at a point above the fill level thereby creating voids within hole 58 where rod 46 would not be grounded to the surrounding earth. This is accomplished, at least in part, as the concentrically narrowing ribbed sidewalls of funnel 108 cause the fines and chips of bentonite to begin rolling down the ribbed sidewalls of the funnel 108 as they are directed by the concentricity of funnel 108 to the center of the bore hole 58. Bentonite is poured into bore hole 58 using device 100 until the sound of the bentonite hitting water is no longer detected. The process of adding water, if needed, and bentonite to the bore hole 58 using device 100 is continued until the bentonite/water mixture is within 10-20 feet of the mouth of the bore hole 58. The device 100 may then be removed from the bore hole 58 and the remaining bentonite that was screened away (such as accumulated dust particles) poured into the hole 58 until full. The process of backfilling the bore hole 58 with bentonite is typically performed before device 10 is used to drive rod 46 into bore hole 58. In effect, the bentonite poured in bore hole 58 fills the void that would otherwise exist between the rod 46 and the sidewalls of hole 58 and provides a glue to adhere and ground rod 46 to the surrounding earth of hole 58. Thus, once hole 58 has been filled adequately with bentonite, consecutive sections of rod 46 may be driven through the bentonite in bore hole 58 until the desired resistance reading is attained by measuring as set forth in the preceding paragraphs.

Figure 7:
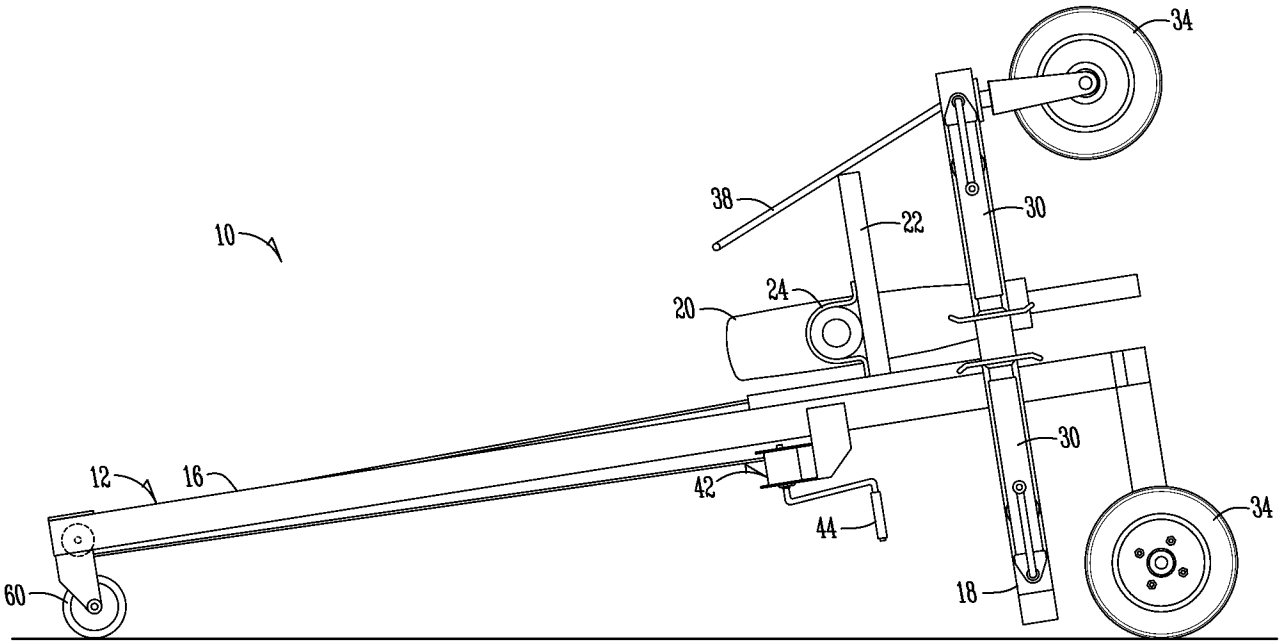
FIG. 7 is a front elevation view of the driver device in a position for trailering and transporting.

FIG. 7 shows how the device 10 may be turned over on its back so as to be supported by wheels 60 and 34 for trailering and transporting to another installation site 56.

Therefore a device for deep earth grounding and related systems and methods has been disclosed. The present invention contemplates numerous variations, options, and alternatives and is not to be limited to the specific embodiment described herein.

What is claimed is:

1. A ground rod driver device, comprising:

a frame having vertical members extending from top to bottom and horizontal members from front to back;

an impact hammer assembly operatively connected to the frame and adapted for vertical movement along the vertical members;

wherein the impact hammer assembly comprises horizontal guide rails, the horizontal guide rails are moveable between upper and lower positions relative to the horizontal members;

an impact hammer operatively connected to the horizontal guide rails and moveable between inward and outward positions relative to the vertical members;

a hand crank assembly operatively connected to the frame and configured for raising the impact hammer assembly up and down along the vertical members of the frame.

2. The driver device of claim 1 further comprising a plurality of jacks operatively connected the frame.

3. The driver device of claim 1 further comprising a pair of front wheels operatively connected to opposite ends of the frame, each of the front wheels having independent 360 degree movement.

4. The driver device of claim 1 wherein the frame provides open front access between the horizontal members.

5. A ground rod driver device, comprising:

an open front frame having vertical members spaced apart extending from top to bottom and horizontal members spaced apart extending from front to back;

a carriage having vertical guide rails operatively connected to and adapted for movement along the vertical members, the carriage having horizontal guide rails attached to the vertical guide rails and spaced apart extending from generally front to back;

the horizontal guide rails are moveable between upper and lower positions relative to the horizontal members;

an impact driver operatively connected to and adapted for movement along the horizontal guide rails;

the impact driver is moveable inward toward and outward away from the vertical guide rails; and a crank assembly operatively connected to the frame and the carriage for moving the impact driver up and down along the vertical members.

6. The driver device of claim 5 further comprising a plurality of jacks operatively connected to the horizontal members to level and stabilize the frame.

7. The driver device of claim 5 wherein the opening between horizontal members provides open front access to the carriage and the frame.

8. A ground rod driver device, comprising:

a frame having vertical members extending from top to bottom and horizontal members from front to back;

an impact driver assembly having:

a) vertical guide rails operatively connected to the vertical members and moveable between upper and lower positions along the vertical members;

b) horizontal guide rails fixed to the vertical guide rails;

c) impact driver attachments operatively connected to the horizontal guide rails and moveable between inward and outward positions along the horizontal guide rails; and d) an impact hammer rotatably attached to the horizontal guide rails by the impact driver attachments.

9. A ground rod driver device, comprising:

an open front frame having:

a. vertical members spaced apart extending from top to bottom;

b. horizontal members spaced apart extending from front to back;

an impact driver carriage having:

a. vertical guide rails operatively connected to and adapted for movement along the vertical members;

b. horizontal guide rails rigidly fixed to the vertical guide rails and spaced apart extending from generally front to back; and an impact driver operatively connected to and adapted for movement along the horizontal guide rails inward toward and outward away from the pair of vertical guide rails.

10. The driver device of claim 9 wherein the impact driver carriage further comprises a pair of rollers on counterpoising sides of the impact driver for supporting movement of the hammer while impacting ground rod.

11. The driver device of claim 9 wherein the impact driver is moveable between:

a. a first position adjacent both the vertical guide rails and the vertical members; and b. a second position generally adjacent a distal end of the horizontal guide rails.

12. The driver device of claim 9 wherein the horizontal guide rails are moveable between upward and downward positions relative to the horizontal members.

* * * * *